United States Patent [19]

Belbel et al.

[11] Patent Number: 4,647,741

[45] Date of Patent: Mar. 3, 1987

[54] SWITCHING DEVICE WITH ANTIARCING SCREEN

[75] Inventors: Elie Belbel, Epinay sur Seine; Michel Lauraire, Courbevoie; Luc Moreau, Dijon; Pierre Lemarquand, Velars sur Ouche; Serge Paggi, Ruffey les Echirey; Patrick Comtois, Chevigny Saint Sauveur, all of France

[73] Assignee: La Telemecanique Electrique, France

[21] Appl. No.: 835,866

[22] PCT Filed: May 3, 1985

[86] PCT No.: PCT/FR85/00105

§ 371 Date: Dec. 31, 1985

§ 102(e) Date: Dec. 31, 1985

[87] PCT Pub. No.: WO85/05218

PCT Pub. Date: Nov. 21, 1985

[30] Foreign Application Priority Data

May 3, 1984 [FR] France ..... 84 06878

[51] Int. Cl.[4] ..... H01H 33/06

[52] U.S. Cl. ..... 200/151

[58] Field of Search ..... 200/151

[56] References Cited

U.S. PATENT DOCUMENTS

| | | | |
|---|---|---|---|
| 663,612 | 12/1900 | Oxley | 200/151 |
| 1,833,173 | 11/1931 | Murray et al. | 200/151 |
| 2,493,419 | 1/1950 | Puffer | 200/151 |
| 2,714,144 | 7/1955 | Amundson | 200/146 |
| 2,928,910 | 3/1960 | Watterberg | 200/151 |
| 4,426,562 | 1/1984 | Kemeny | 200/151 |

FOREIGN PATENT DOCUMENTS

| | | | |
|---|---|---|---|
| 735601 | 5/1943 | Fed. Rep. of Germany | 200/151 |
| 1015897 | 9/1957 | Fed. Rep. of Germany | 200/151 |
| 1217162 | 12/1959 | France | 200/151 |
| 1282733 | 12/1961 | France | 200/151 |

*Primary Examiner*—Robert S. Macon

*Attorney, Agent, or Firm*—William A. Drucker

[57] ABSTRACT

The disclosure relates to a switching device which comprises a casing provided with an input terminal, an output terminal and, therebetween, an electric circuit including at least two separable contacts as well as a rotary screen presenting an interposable annular sector between the contacts and displaceable vis-a-vis a wall comprising an opening for the passage of at least one of the contacts. The wall delimits in the casing two volumes as well as a lamellar space enabling to provide for the rolling and cooling of the arc. The space communicates with a chamber which enables the gas expulsion with expansion to the chamber. The invention enables to obtain a simple and inexpensive way of reliably breaking the arc.

14 Claims, 5 Drawing Figures

SWITCHING DEVICE WITH ANTIARCING SCREEN

The present invention relates to a current threshold switching device comprising, in a case, an input terminal, an output terminal and therebetween an electric circuit comprising at least two separable contacts, as well as a rotary screen having an annular wall interposable between the contacts and movable about an axis along a predetermined circumferential path from a first position to a second position, the annular wall moving opposite a fixed wall of cylindrical shape and concentric with the annular wall, said fixed wall comprising an opening for the passage of one at least of the contacts.

In U.S. Pat. No. 2,714,144, such a switching device is described using a cylindrical rotary screen housed between a fixed cylindrical inner core and a fixed cylindrical outer casing. The increase in pressure caused by a current breaking arc risks however causing an explosion of the device; in addition, during normal operation of the device, the gases are discharged to the atmosphere through a simple vent and cause pollution.

It is known from U.S. Pat. No. 1,833,173 and FR Pat. No. 1 217 162 to use, in a switching device for chopping an electric arc generated by the opening of the contacts, a screen in the form of a cylindrical sector interposable between the contacts.

It should be recalled that chopping of an electric arc is achieved provided that a sufficient arc tension is interposed in the circuit. This arc tension corresponds to a resistance of the plasma of the arc which is essentially dependent on its conductivity J, its length L and it section S in accordance with the relationship $R_{arc}=1/J.L/S$; furthermore the conductivity of the arc is reduced when its temperature is lowered. It will moreover be readily understood that the time for the appearance of the arc tension and the increase thereof dv/dt, factors which are preponderant for ensuring a good chopping action, will be dependent on the speed of the screen as is stated in the patent application Ser. No. FR 83 01749 of the Feb. 4, 1983 in the name of the applicant.

Rotary screen switching devices of the prior art do not take sufficient advantage of the rotary character of the screen and are generally limited to confining the arc at the end of travel in a slot into which the front edge of the screen penetrates. Furthermore, the above mentioned patent application Ser. No. FR 83 01749 describes a switching device using an arc shearing means formed by a rotary screen which may be propelled at a speed of at least 5m/s between the contacts and engaging at the end of travel in a sealed abutment slit. The result however is a high overpressure of the ionized gases which in some cases requires appropriate arrangements.

The aim of the present invention is to provide a rotary screen switching device providing in a simple and inexpensive way reliable chopping of the arc and avoiding the risks of pollution and explosion.

A further aim is to arrange the arc chopping system so that it may be housed in a switching device of small volume and more particularly small thickness.

In accordance with the invention, in a device of the type mentioned above, the cylindrical fixed wall defines in the case two volumes situated on each side of the wall, whereas a cylindrical lamellar space of a considerable length and small height is defined between the radially inner face of the wall and the radially outer face of the annular sector for defining, in said space, a lamellar path for laminating and cooling the arc, the lamellar space communicating permanently with one at least of the two volumes for allowing expulsion of the gases with expansion from said space to said volume.

By laminating is meant in the present description that an upper limit is imposed on the section of the arc.

Cooling of the plasma of the arc takes place then along the fixed concave wall, the great length of this latter being able to be housed nevertheless in a relatively reduced space of the switching device because of the rounded shape of said wall. This rounded shape, in combination, with the pivoting axis serving as reference axis, allows slight variations of radial play between the fixed wall and the annular sector without causing friction or jamming of the screen. The fixed wall may for example extend over about a quadrant at least downstream of the zone of the contacts in the direction of travel of the screen, so as to cause appreciable cooling of the arc.

In a preferred embodiment, the annular sector of the screen forms a cap connected to the pivot pin by at least one connecting flange in the form of a circular sector situated opposite a fixed flange integral with the case and separated therefrom by a lamellar space for defining a complementary lateral and lamellar path communicating between the lamellar space and the expansion volume or volumes.

The inside of the shell thus formed by the screen defines a portion of the expansion volume.

The connecting flange of the screen and the fixed flange of the case may advantageously have baffles in the form of anhular cooperating ribs ahd notches for increasing the lateral lamellar paths.

Other features and advantages of the invention will be more clearly understood from the following description with reference to the drawings in which.

Figure 1:
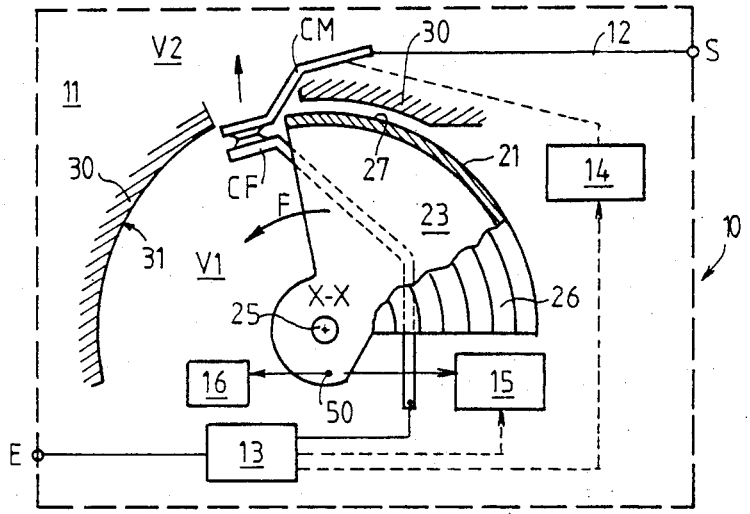
FIG. 1 is a partial view in longitudinal section of a switching device equipped with a screen of the invention and shown in its position with contacts closed.
Figure 2:
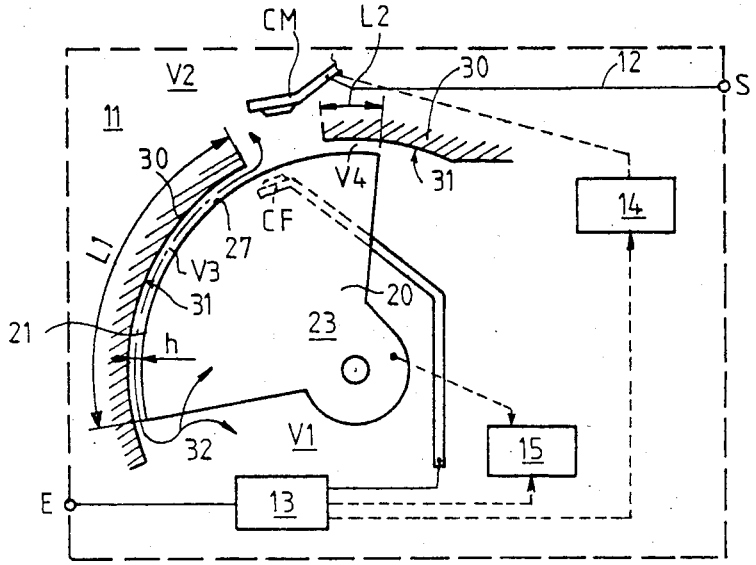
FIG. 2 shows the screen in its position with the contacts open.

The switching device 10 shown in FIG. 1 is a current threshold device comprising, in a case 11, an input terminal E and an output terminal S between which is located an electric circuit 12 comprising at least two separable contacts; these contacts are shown schematically in FIG. 1 by a fixed contact CF and a mobile contact CM. The mobile contact CM is connected to the terminal S and the fixed contact CF is connected to the input terminal E by means of a tripping device 13.

The tripping device 13 comprises a magnetic member with armature movable, for example, in the case of an overcurrent for on the one hand opening the contacts by means of a mechanism 14 and, on the other, for moving the screen via a propulsive means shown schematically at 15.

The switch device 10 comprises a rotary screen 20 which has an annular sector 21 in the form of a cylindrical cap and two side flanges 22, 23 for connection with pins 24, 25 allowing pivoting about an axis X-X. The screen 20 is molded as a single piece from an insulating material. It is provided on the outer face of the flanges 22, 23 with annular ribs 26 whose purpose will be explained further on. The flanges of the annular sector cover, in the present example, an area greater than a quadrant.

The case comprises a fixed cylindrical wall 30 defining on each side a volume $V_1$,$V_2$. In accordance with the invention, a cylindrical lamellar space $V_3$ is generated by movement of the screen and is inserted between the volumes $V_1$ and $V_2$. The lamellar space $V_3$ of a circumferential length $L_1$, for example from 5 to 15 mm, and of a small thickness h, for example from 0.1 to 0.7 mm, is formed between the radially inner face 31 of wall 30 and the radially outer face 27 of the annular sector 21 of the screen. The fixed wall 30 covers a space of about a quadrant downstream of the zone of the contacts CF, CM with respect to the direction of movement of the screen during opening of the contacts, this direction being shown by the arrow F.

The lamellar space $V_3$ defines a path capable of laminating, lengthening and cooling the arc and it communicates permanently with a chamber 32 provided in volume $V_1$ for expelling the gases with expansion from space $V_3$ towards chamber 32 and from this latter towards the atmosphere.

A lamellar space $V_4$ exists downstream of the zone of the contacts during the whole movement of the screen over a length $L_2$ sufficient for avoiding reflux of the arc.

Figure 3:
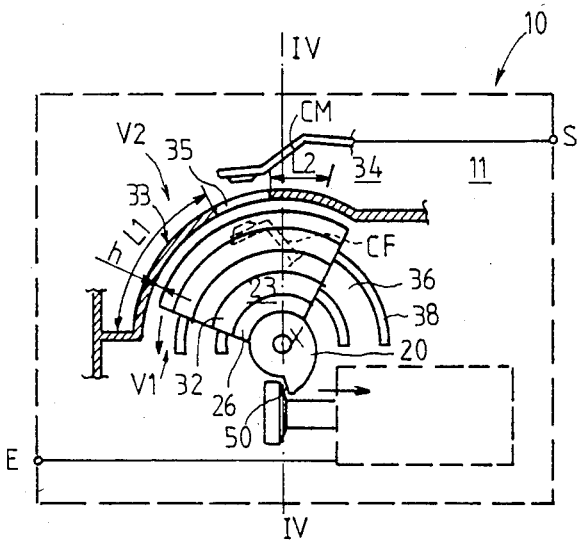
FIG. 3 shows another embodiment of the device.
Figure 4:
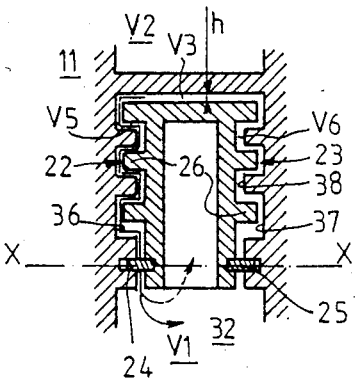
FIG. 4 is the section of the device of FIG. 3 through the plane IV—IV passing through the pivoting axis.

The fixed cylindrical wall 30 is preferably formed (FIG. 3) by a dividing wall 33 separating the inside of case 11 into a volume $V_1$ comprising the chamber 32 and a volume $V_2$ comprising a chamber 34; the dividing wall 33 comprises an opening 35 which, on the one hand, allows the mobile contact CM to be raised towards chamber 34 and, on the other, the gases to be expelled from volume $V_3$ towards this same chamber in addition to their expulsion towards chamber 32.

Case 11 comprises, opposite the lateral flanges 22, 23 of the screen, fixed flanges 36, 37 which extend over a circumferential distance approximately equal to $L_1+L_2$ and which are provided with annular ribs and grooves 38 complementary to the ribs and grooves 26 of the rotary screen; the annular shaped elements 38 define lateral lamellar spaces $V_5$, $V_6$ associated respectively with the flanges 22, 23 and of a length greater than the radius of the annular sector.

These spaces, for example of a height between 0.1 and 0.7 mm, assist space $V_3$ for obtaining more intense lamination and better cooling of the arc; the ionized gases of the arc will in fact find in these spaces a lamellar path towards chamber 32.

It can be seen that the rotary nature of the screen, in combination with the previously defined lamellar spaces $V_3$ to $V_6$, results in a reduced length of the switching device, as well as considerable lamination and cooling since an arc path is imposed both along the annular sector and the lateral flanges of the screen.

Figure 5:
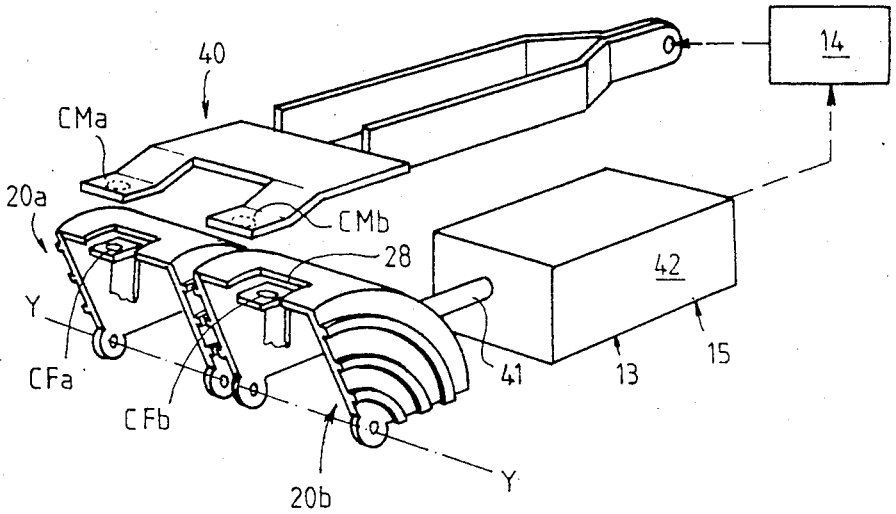
FIG. 5 shows in perspective a double chopping device in accordance with the invention.

The switching device shown in FIG. 5 comprises a double chopping member 40, having more precisely fixed contacts $CF_a$ and $CF_b$ and mobile contacts $CM_a$, $CM_b$ having the particularity of comprising two rotary screens 20*a*, 20*b* in accordance with the invention; these screens have an indentation 28 for the passage of the contacts and they have their pivoting axes merged along Y-Y; they cooperate for example by means of a push or pull rod 41 with a single armature of the magnetic tripper 42. The result is great simplicity and a reduced size for the device.

On screen 20 there is advantageously provided a drive element or face 50 for cooperation with a drive means 41 associated with the magnetic tripping device (FIG. 1), this latter then forming directly the means for propelling the screen; a return device 16 is preferably associated with the screen for bringing it back to its original position. The drive face 50 is for example situated advantageously on the side opposite the annular sector 27 with respect to the pivoting axis X-X and at a relatively small radial distance from this axis with respect to the radial distance of the annular sector.

An energy accumulator system may be associated with the screen for forming, in interdependence with the magnetic tripping device 13, the means for propelling the screen.

In a very simple embodiment, a drive face is provided on the rotary screen 20 for cooperating with an actuating face of mechanism 14 for opening the contacts, this mechanism comprising a resilient tripping system.

It goes without saying that modifications may be made to the switching device described without for all that departing from the scope and spirit of the invention.

We claim:

1. A current threshold switching device comprising a case having an input terminal, an output terminal and therebetween an electric circuit comprising at least two separable contacts, as well as a rotary screen having an annular wall interposable between the contacts and movable about an axis along a predetermined circumferential path from a first position to a second position, the annular wall moving opposite a fixed wall of cylindrical shape and concentric with the annular wall, this fixed wall comprising an opening for the passage of one at least of the contacts, whereas a cylindrical lamellar space ($V_3$) of appreciable length ($L_1$) and small thickness "h" is defined between the radially inner face (31) of the fixed wall and the radially outer face (27) of the annular wall (21) of the screen (20), for defining a lamellar path in said space, characterized in that:

the annular wall (21) is formed by an annular sector;

the fixed cylindrical wall (30) is integral with the case;

two expansion volumes ($V_1$, $V_2$) are defined in the case on each side of the fixed wall (30), the size of these volumes being appreciably larger than that of the lamellar space ($V_3$), the lamellar space permanently communicating with the two volumes ($V_1$, $V_2$) for allowing expulsion of the gases with expansion from said space towards said volumes inside the case.

2. Switching device according to claim 1, characterized by the fact that the fixed cylindrical wall (30) is formed on a circular dividing wall (33) of the case separating the inside of this latter into two volumes ($V_1$, $V_2$) each of which contains an expansion chamber for the gases coming from the lamellar space ($V_3$).

3. The switching device according to claim 1, characterized by the fact that the fixed cylindrical wall (30) and the annular sector (21) of the screen (20) extend over about a quadrant upstream and/or downstream of the zone of the contacts (CF, CM) in the direction of travel of the screen.

4. Switching device according to claim 1, characterized by the fact that the annular sector (21) of the screen (20) forms a cap connected to the pivot pin by at least one connecting flange (22, 23) in the form of a circular sector situated opposite a fixed flange (36, 37) integral with the case (11) and separated therefrom by a lamellar space ($V_5$, $V_6$) for defining a complementary lateral and lamellar laminating and cooling path between the circumferential lamellar space ($V_3$) and the expansion volume or volumes ($V_1$, $V_2$).

5. Device according to claim 1, characterized by the fact that the extent of the circumferential travel ($L_1$) of the annular sector (21) of the screen is between 5 and 15 mm and that the height of the lamellar space ($V_3$) situated between the annular sector and the fixed dividing wall (33) is between 0.1 and 0.7 mm.

6. Device according to claim 4, characterized by the fact that the connecting flange (22, 23) of the screen (20) and the fixed flange (36, 37) of the case (11) have baffles in the form of cooperating annular ribs and notches (26, 38) which create a lamellar lateral path ($V_5$, $V_6$) between the lamellar space ($V_3$) and the chamber (32) of the volume ($V_1$).

7. Device according to claim 1, characterized by the fact that the annular sector (21) of the screen and the lateral flange (22, 23) of the screen are molded as a single piece from an insulating material.

8. The device according to claim 1, characterized by the fact that two rotary screens (**20*a*, 20*b*) are disposed with their axes parallel or merging in the vicinity of a double break mobile contact (40), the two screens cooperating with a single armature (41) of the magnetic tripper (42**).

9. Device according to claim 1, characterized by the fact that a drive element (50) is provided on the screen for cooperating with a drive means (41) associated with the magnetic tripping device (42).

10. Device according to claim 9, characterized by the fact that the drive element (50) provided on the screen is a face situated on the side opposite the annular sector (27) with respect to the pivot axis (X-X) and at a small radial distance from this axis with respect to the radial distance of the annular sector.

11. Device according to claim 9, characterized by the fact that the magnetic tripping device (13) forms directly the means for propelling the screen (20).

12. Device according to claim 9, characterized by the fact than an energy accumulator system is associated with the a screen (20) and forms, in interdependence with the magnetic tripping device (13), the means for propelling the screen.

13. Device according to claim 1, characterized by the fact that a drive face (50) is provided on the rotary screen (20) for driving an actuating face of the mechanism for opening the contacts (14), this mechanism comprising a resilient tripping system.

14. Device accoridng to claim 1, characterized by the fact that a return device (16) is provided for bringing the screen back from its second position to its first position.

* * * * *